US008178175B2

(12) United States Patent
Ionkin

(10) Patent No.: US 8,178,175 B2
(45) Date of Patent: May 15, 2012

(54) THERMAL TRANSFER DONOR ELEMENTS WITH IONIC LIQUIDS

(75) Inventor: Alex Sergey Ionkin, Kennett Square, PA (US)

(73) Assignee: E I du Pont de Nemours and Company, Wilmington, DE (US)

( * ) Notice: Subject to any disclaimer, the term of this patent is extended or adjusted under 35 U.S.C. 154(b) by 834 days.

(21) Appl. No.: 12/266,044

(22) Filed: Nov. 6, 2008

(65) Prior Publication Data

US 2010/0112237 A1 May 6, 2010

(51) Int. Cl.
*B41M 5/392* (2006.01)

(52) U.S. Cl. ..... 428/32.6; 428/32.81

(58) Field of Classification Search ..... None
See application file for complete search history.

(56) References Cited

U.S. PATENT DOCUMENTS 7,763,411 B2 * 7/2010 Felder et al. ..... 430/200
* cited by examiner

*Primary Examiner* — Bruce H Hess

(57) ABSTRACT

Disclosed herein are compositions derived from a polycarboxylic acid, and an ionic liquid. The compositions can be used to prepare thermal transfer donor elements.

11 Claims, 2 Drawing Sheets

THERMAL TRANSFER DONOR ELEMENTS WITH IONIC LIQUIDS

FIELD OF THE INVENTION

The present invention relates to thermal transfer donor elements, methods of using such elements, and articles formed by such methods.

BACKGROUND

Thermal transfer processes that use radiation to transfer material from a donor element to a receiver are known. Thermal transfer imaging processes are used in applications such as color proofing, electronic circuit manufacture, the manufacture of monochrome and color filters, and lithography.

Color filters can be manufactured by thermally transferring a layer of colored material from a thermal transfer donor element onto a receiver. Typically, the transferred layer comprises a polymeric material and one or more dyes and/or pigments. The polymeric material can comprise a cross-linkable binder that can be cured to form a more chemically and physically stable layer, one that is less susceptible to damage.

There remains a need, however, to identify compositions that, when annealed, produce color filters with improved properties. Desirable properties include lower surface roughness, lower lip heights, lower pixel heights, and a high percentage transfer of the donor onto the receiver.

SUMMARY OF THE INVENTION

Figure 1:
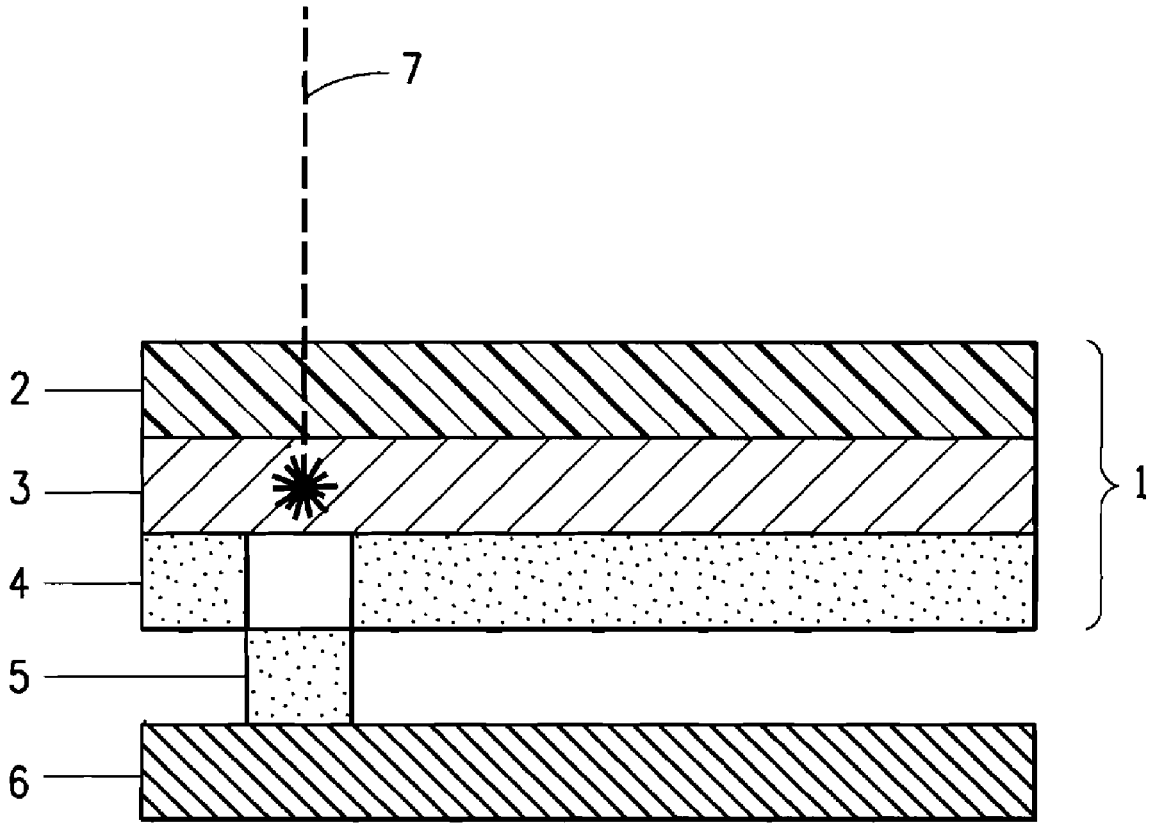
FIG. 1 is a schematic of an imageable assemblage and a thermal laser printing process.

One aspect of the present invention is a thermal transfer donor element comprising:

(a) a support;

(b) a thermal transfer layer disposed upon the support, wherein the thermal transfer layer is derived from a composition comprising a polycarboxylic acid and an ionic liquid; and (c) an infrared-absorbing compound.

Another aspect of the present invention is a process comprising:

(a) coating a support with a composition comprising:

(i) a polycarboxylic acid;

(ii) an ionic liquid; and (iii) a laser dye; and (b) heating the coated support.

A further aspect of the invention is an imageable assemblage comprising:

(a) a donor element comprising a transparent donor support and a thermal transfer layer disposed on the support, wherein the thermal transfer layer is derived by heating to a temperature within the range 40° C. to 60° C. a composition comprising a polycarboxylic acid and an ionic liquid; and (b) a receiver in contact with the thermal transfer layer of the donor element.

Another aspect of the invention is a transfer process comprising:

(a) providing an imageable assemblage that comprises a donor element comprising a transparent donor support having a first surface and a second surface, a thermal transfer layer disposed on the second surface of the support, and a receiver in contact with the thermal transfer layer of the donor element;

(b) directing laser radiation to the first surface of the transparent donor support;

(b) heating a portion of the thermal transfer layer to cause the portion to transfer to the receiver; and (c) separating the receiver from the donor element.

DETAILED DESCRIPTION

Disclosed are thermal transfer donor elements comprising:

(a) a support;

(b) a thermal transfer layer supported by the support, wherein the thermal transfer layer is derived from a composition comprising a polycarboxylic acid and an ionic liquid; and (c) an infrared absorbing compound.

In preferred embodiments, a laser source of infrared radiation is used in the transfer processes disclosed herein, and the infrared absorbing compound is a laser dye. Infrared-absorbing laser dyes are commercially available and are known in the art.

The thermal transfer donor elements can be used, for example, to prepare color filters, which are used to prepare color filter films. The color filter films can be used, for example, in liquid crystal display devices, in which color filters that exhibit low surface roughness, low lip heights, low pixel heights, and a high percentage transfer of the donor onto a receiver are desirable.

Also disclosed are processes for forming thermal transfer donor elements for use in thermal transfer processes.

Also disclosed are imageable assemblages of a thermal transfer donor element and a receiver.

Also disclosed are processes for transferring at least a portion of a thermal transfer layer from a thermal transfer donor element onto a receiver.

In one embodiment, the thermal transfer donor element comprises a support, a thermal transfer layer supported by the support, and a laser dye. The thermal transfer donor element can further comprise a heating layer disposed between the support and the thermal transfer layer.

Suitable supports for use in the thermal transfer donor element include materials that are dimensionally stable and are not degraded or deformed by the heat of a thermal printing process. "Dimensionally stable" means that the support material does not detectably melt, decompose or otherwise deform at the temperatures used in the processes disclosed herein. Suitable support materials include polyester films, polyolefin films, polyamide films, paper, glass, and fluoro-olefin films. In some embodiments, the support is transparent to infrared or near infrared radiation. The support is typically 200 microns to 3000 microns thick, although thicker supports can also be used, preferably from 1000 microns to 2000 microns. In some embodiments, the support is flat and has a uniform thickness, according to generally accepted industry standards.

The thermal transfer layer of the thermal transfer donor element, which is deposited onto the support prior to deposition of a pigment composition, is derived from a composition comprising a polycarboxylic acid and an ionic liquid. In some embodiments, the composition further comprises a polyhydroxy compound wherein the polyhydroxy compound is selected from the group consisting of 7,7,11,11-tetrakis[2-(2-hydroxyethoxy)ethoxy]-3,6,9,12,15-pentaoxahepta-decane-1,17-diol, and N1,N1,N7,N7-tetrakis (2-hydroxyethyl)heptanediamide. The polycarboxylic acid and polyhydroxy compound can react to form a cross-linked polymer. The polyhydroxy compound is also referred to herein as the polyol compound.

The term "polycarboxylic acid" refers to an organic acid containing two or more carboxyl (COOH) groups. Herein, the polycarboxylic acid is a copolymer comprising repeat units derived from styrene and from one or more carboxylic comonomers, wherein the carboxylic comonomers are selected from the group consisting of acrylic acids, methacrylic acids, and combinations thereof. In some embodiments, the polycarboxylic acid copolymer used in the thermal transfer layer has a molecular weight of 2,000 to 50,000 g/mole. Preferably, the molecular weight is 3,000 to 6,000 g/mole.

The term "ionic liquid" as used herein is a liquid at temperatures below 100° C. that contains essentially only ions. Some ionic liquids are in a dynamic equilibrium, where at any time greater than 99% of the liquid is made up of ionic rather than molecular species. Ionic liquids can contain anions and cations. Suitable cations in the ionic liquid include ammonium, choline, imidazolium, phosphonium, pyrazolium, pyridinium, pyrrolidinium, sulfonium, and combinations thereof. Suitable anions in the ionic liquid include carbonate, acetate, benzoate, phosphates, sulfonates, fluoride, chloride, bromide, iodide, hydroxide, nitrite, bistrifluoromethanesulfonimidate, nonafluorobutanesulfonate, thiophenolate, succinimide, tribromide, triiodide, trifluoroacetate, salicylate, hexafluorophosphate, tetrafluoroborate, dibutylphosphate, dicyanamide, hexafluoroantimonate, methanesulfonate, methyl sulfonate, methyl sulfate, nitrate, tetrachloroaluminate, tosylate, thiocyanate, dimethylphosphate, tris(trifluoromethylsulfonyl)methanide, ethyl sulfate, methyl carbonate, diethyl phosphate, lactate, decanoate, and combinations thereof. Prefererred ionic liquids include tributylmethylphosphonium dibutyl phosphate, tris(2-hydroxyethyl)methylammonium methylsulfate, 1,2,4-trimethylpyrazolium methylsulfate, and 1-butyl-3-methylimidazolium tetrafluoroborate.

The thermal transfer donor element also contains an infrared absorbing compound, such as a laser dye. Typically, the infrared absorbing compound, e.g., laser dye, is present in the thermal transfer layer. Alternatively, the infrared absorbing compound can be present in a heating layer disposed between the support and the thermal transfer layer. Suitable laser dyes include, for example, 1H-benz[e]indolium, 2-[2-[2-chloro-3-[[1,3-dihydro-1,1-dimethyl-3-(4-sulfobutyl)-2H-benz[e]indol-2-ylidene]ethylidene]-1-cyclohexen-1-yl]ethenyl]-1,1-dimethyl-3-(4-sulfobutyl)-, inner salt and related structures.

In some embodiments, the thermal transfer layer further comprises a surfactant and/or a defoaming agent. Suitable surfactants include salts of 3-[2-(perfluoroalkyl)ethylthio]propionate, for example, lithium 3-[2-(perfluoroalkyl)ethylthio]propionate. Suitable defoaming agents include acetylenic glycol non-ionic surfactants.

In some embodiments, the thermal transfer donor element comprises a heating layer, and the heating layer comprises an infrared absorbing compound. The infrared absorbing compound is selected from the group consisting of organic and inorganic materials that absorb infrared radiation, e.g., at 830 nm. Suitable inorganic materials for use in the heating layer include carbon black, transition metal elements (scandium, yttrium, titanium, zirconium, hafnium, vanadium, niobium, tantalum, chromium, molybdenum, tungsten, manganese, iron, ruthenium, osmium, cobalt, rhodium, iridium, nickel, palladium, platinum, copper, silver, and gold), metallic elements (aluminum, gallium, indium, tin, lead, antimony, and alloys thereof), metal oxides, and alloys of aluminum, gallium, tin, or lead with the alkaline metals or alkaline earth metals (sodium, lithium, calcium, magnesium, and strontium).

Suitable organic materials for use in the heating layer are organic compounds that absorb laser light at infrared wavelengths. Such compounds can be selected from the group consisting of infrared or near infrared absorbing dyes. Suitable near infrared absorbing dyes include poly(substituted) phthalocyanine compounds; metal-containing phthalocyanine compounds; cyanine dyes; squarylium dyes; croconium dyes; oxyindolizine dyes; bis(chalcogenopyrylo)polymethine dyes; metal thiolate dyes; bis(aminoaryl)polymethine dyes; merocyanine dyes; quinoid dyes and combinations thereof.

In some embodiments, the thermal transfer layer further comprises a colorant selected from the group consisting of organic pigments, inorganic pigments, dyes, and combinations thereof. Suitable pigments, in a wide variety of colors, that are dispersed or dispersible in an aqueous formulation, are commercially available.

In one embodiment, the colorant of the thermal transfer layer comprises a green pigment and a yellow pigment. In one embodiment, the green pigment comprises a copper phthalocyanine complex. Suitable copper phthalocyanine complexes include copper, (1,3,8,16,18,24-hexabromo-2,4,9,10,11,15,17,22,23,25-decachlorophthalocyaninato(2−)); and copper, [tridecachloro-29H,31H-phthalocyaninato(2−)-N29,N30,N31,N32]-.

In one embodiment, the yellow pigment comprises an azobarbituric acid metal complex. Suitable yellow pigments include nickel, [[5,5'-(azo-κN1)bis[2,4,6(1H,3H,5H)-pyrimidinetrionato-κO4]](2−)]-, compound with 1,3,5-triazine-2,4,6-triamine.

Suitable red pigments for the thermal transfer layer include 2-(3-oxobenzo[b]thien-2(3H)-ylidene)-benzo[b]thiophene-3(2H)-one and N-(2,3-dihydro-2-oxo-1H-benzimidazol-5-yl)-3-oxo-2-[[2-trifluoromethyl)phenyl]azo]butyramide.

Suitable blue pigments for the thermal transfer layer include alpha-copper phthalocyanine and diindolo[2,3-c:2',3'-n]triphenodioxazine, 9,19-dichloro-5,15-diethyl-5,15-dihydro-.

Other suitable pigments include carbon black, graphite, pigment violet 7, pigment blue 15:6, pigment violet 23, pigment red 254, pigment yellow 83 and 180 and pigment green 36. Mixtures of pigments and/or dyes can be used to produce other colors, such as orange or purple.

Another embodiment is a process for preparing a thermal transfer donor element comprising:

(a) coating a support with a composition comprising a polycarboxylic acid, an ionic liquid, and an infrared absorbing compound, to form a coated support; and (b) heating the coated support.

In some embodiments, the composition used to coat the support is prepared as an aqueous formulation comprising 25 to 40 wt % polycarboxylic acid, 31 to 41% pigments, and 1 to 25 wt % ionic liquids, based on dry weight measurements. In some embodiments, 2 to 8 wt % (based on dry weight measurements) of the aqueous formulation is a polyhydroxy compound or polyol compound. The composition can further comprise colorants selected from the group consisting of organic pigments, inorganic pigments, dyes, and combinations thereof; surfactants; de-foaming agents; and other additives.

In another embodiment, the composition used to coat the support is prepared as an aqueous formulation comprising 25 to 40 wt % polycarboxylic acid, 31 to 41% pigments, and 1 to 15 wt % ionic liquids, based on dry weight measurements.

"Based on dry weight measurements" means the total combined weight of the composition excluding the weight of any water.

In another embodiment, the composition used to coat the support is prepared as an aqueous formulation comprising 30-35 wt % polycarboxylic acid, 31 to 41% pigments, and 1 to 25 wt % ionic liquids, based on dry weight measurements.

In yet another embodiment, the composition used to coat the support is prepared as an aqueous formulation comprising 25 to 40 wt % polycarboxylic acid, 35 to 40% pigments, and 1 to 25 wt % ionic liquids, based on dry weight measurements.

In one embodiment, the composition used to coat the support is prepared as an aqueous formulation comprising 25 to 40 wt % polycarboxylic acid, 35 to 40% pigments, and 2 to 15 wt % ionic liquids, based on dry weight measurements.

The aqueous formulation is typically prepared by mixing the pigments (if any) with water and the polycarboxylic acid, followed by the addition of the infrared absorbing compound, e.g., laser dye, and other optional components, such as other colorants, surfactants and de-foaming agents, and further mixing. The aqueous formulation is then coated onto the support by any of several conventional coating techniques, including but not limited to spin-coating, doctor blade coating, spraying, dip-coating, or draw-down coating.

In some embodiments, the coated support is heated at 40° C. to 60° C. to obtain a dry film of the thermal transfer layer on the support. In some embodiments, the thermal transfer layer can be further heated at 200° C. to 300° C. to produce an annealed film on the support.

Alternatively, the thermal transfer layer can be transferred to a receiver by, for example, a thermal laser printing process before annealing. FIG. 1 depicts one embodiment of a thermal transfer donor element (1) comprising a support (2), an optional heating layer (3), and a thermal transfer layer (4). FIG. 1 also depicts a thermal laser printing process, in which laser radiation (7) is directed to the heating layer, causing a portion (5) of the thermal transfer layer to be released from the donor element and transferred to the receiver (6).

One embodiment is an imageable assemblage comprising:
(a) a donor element comprising a transparent donor support and a thermal transfer layer disposed on the support, wherein the thermal transfer layer is derived by heating to 40° C. to 60° C. a composition comprising a polycarboxylic acid and an ionic liquid and maintaining at the heating temperature, preferably for about 5 minutes, to remove most of the water from the solution to form a film; and
(b) a receiver in contact with the thermal transfer layer of the donor element.

The donor element can further comprise a heating layer disposed between the transparent donor support and the thermal transfer heating layer.

Suitable receivers include polyester films, polyolefin films, polyamide films, paper, sheets of glass, and fluoro-olefin films.

Another embodiment is a process comprising directing laser radiation to the surface of a transparent donor support of the donor element of an imageable assemblage; heating a portion of the thermal transfer layer to cause it to transfer to the receiver; and separating the receiver from the donor element. This process can be used to make a so-called "color filter element" for use in a liquid crystal display. A color filter element typically includes many three-color pixels, each pixel having three windows, and each window having a different color filter (usually red, blue and green), also referred to as the red color filter, blue color filter and green color filter respectively. The color filters partially transmit visible light, so that white light is filtered to become red, blue, and green light after passing through the three filters. The borders of the color filters can be defined by a black matrix.

Figure 2:
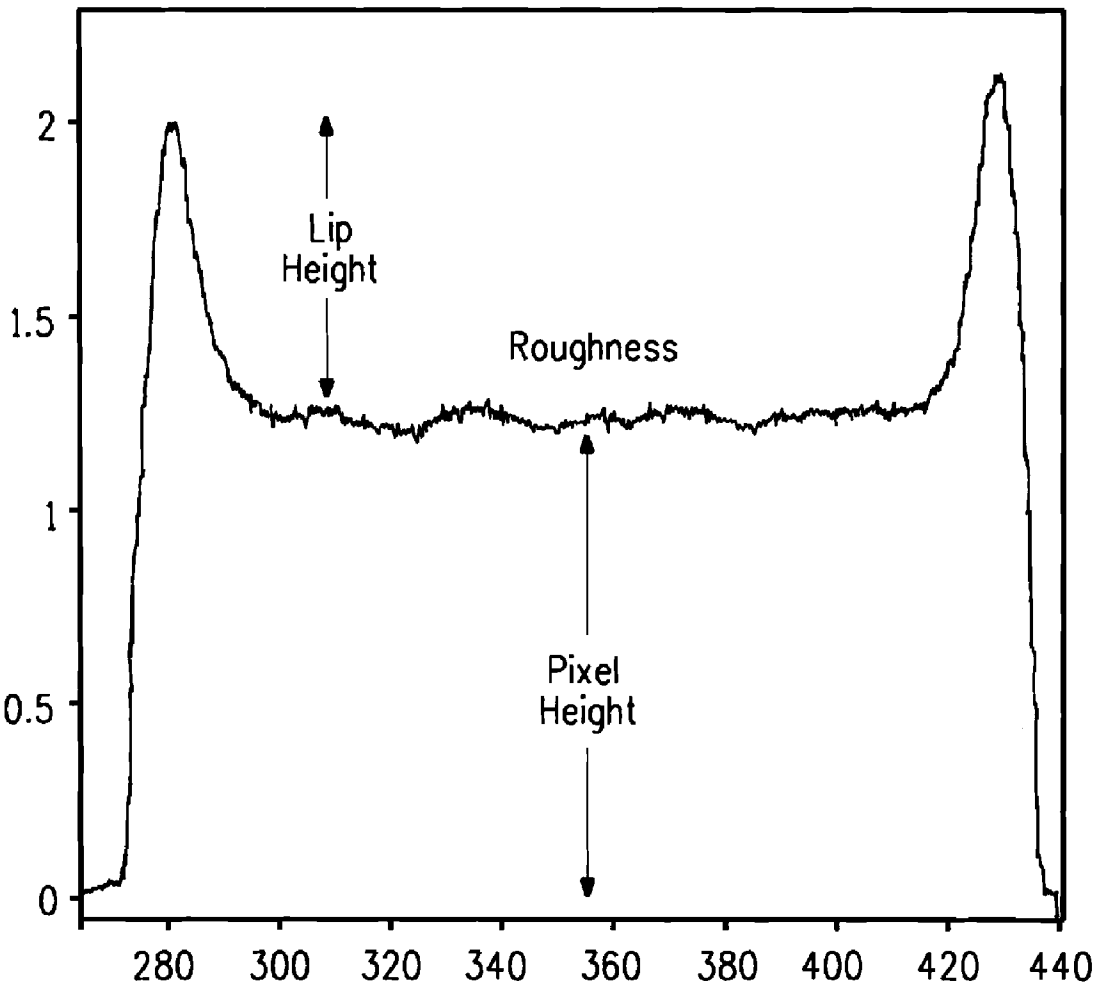
FIG. 2 is a representation of the parameters that are measured on a pixel using a profilometer.

A Tencor P-15 Stylus profilometer can be used to measure surface characteristics of a color filter that has been formed by transferring a portion of thermal transfer layer to the receiver. Typical measurements include the low frequency average roughness (Wa), lip height of the pixel, and pixel height (or step height) of a particular pixel. FIG. 2 shows the height profile and surface characteristics of a color filter using the profilometer.

Wa is a measure of surface roughness, and is roughly correlated with the distance between the top of the bumps and the bottom of the valleys. The pixel height (or step height) average is the averaged height of the transferred material. Lip height refers to the height of a raised feature or edge of the pattern that comprises transfer layer on the receiver element near the margins of the pattern imaged, expressed as the height above the average height of the pattern that comprises transfer layer. A low lip height and low roughness reduce distortions in the light passed through the color filter. There are two lips measured for every color filter, and the average of each is taken to get the average lip height.

The percentage transfer of the thermal transfer layer onto a receiver is influenced by the tackiness of the thermal transfer layer. It is desirable to control this tackiness to ensure that the thermal transfer layer readily transfers to the receiver when exposed to laser radiation or heat, but does not transfer to other surfaces upon casual contact. In particular, the thermal transfer donor elements may be rolled up, and it is undesirable for the thermal transfer layer to stick to the uncoated side of the support. It has been found that in some embodiments, the use of ionic liquids in the thermal transfer layer helps achieve the desired level of tackiness.

The percent transfer of the thermal transfer layer is measured by block testing as is explained further in the Example section. The samples are given a rating depending on the amount of layer that has transferred. If the sample exhibited no transfer to the receiver it was given a rating of 0. The rating system is further described in Table 1.

TABLE 1

Rating system used for block testing.

| Rating | Percent Transfer |
|---|---|
| 0 | none |
| 1 | 5 |
| 2 | 5-10 |
| 3 | 10-20 |
| 4 | 20-30 |
| 5 | 30-40 |
| 6 | 40-50 |
| 7 | >50 |

In one embodiment, a donor film prepared from a blue formulation containing 15% by weight of (1-ethyl-3-methylimidazolium dibutylphosphate) was given a rating of 6 because of a high percentage transfer.

EXAMPLES

The present invention is further defined in the following Examples. These examples are given by way of illustration only. From the above discussion and these examples, one skilled in the art can ascertain the essential characteristics of this invention, and without departing from the spirit and scope thereof, can make various changes and modifications to adapt it to various uses and conditions.

General Information:

Unless otherwise specified below, all chemical reagents, including ionic liquids, were obtained from the Sigma-Aldrich Chemical Co. (St. Louis, Mo.). Pigments were obtained from Penn Color (Doylestown, Pa.).

Carboset® GA 2300 is a carboxylic-acid-containing binder acrylic copolymer (available from Noveon, Inc., Cleveland, Ohio) having a carboxylic acid concentration of approximately 3.6 mM (millimoles) carboxylic acid per gram binder, a Mw of approximately 11,000 grams per mole, and a glass transition temperature of about 70° C., and is available in a volatile carrier.

SDA-4927 is 2-[2-[2-chloro-3[2-(1,3-dihydro-1,1dimethyl-3-(4-dimethyl-3(4-sulfobutyl)-2H-benz[e]indol-2-ylidene)ethylidene]-1-cyclohexen-1-yl]ethenyl]-1,1-dimethyl-3-(sulfobutyl)-1H-benz[e]indolium,inner salt,free acid [CAS No. 162411-28-1]. SDA-4927 (H.W. Sands Corp., Jupiter, Fla.) is an infrared dye that absorbs light of wavelength about 830 nm.

Polyol DPP® 130, also known as poly(oxy-1,2-ethanediyl), -hydro-T-hydroxy-, ether with 2,2'-(oxybis(methylene))bis(2-hydroxymethyl)-1,3-propanediol) (6:1) (CAS No. 50977-32-7), is an ethoxylated dipentaerythritol polymer clear liquid, available from Perstorp Polyols Inc, Toledo, Ohio, that comprises a $(—CH_2)_3CCH_2OCH_2C(CH_2—)_3$ chemical structure.

The fluorosurfactant contains a salt of 3-[2-(perfluoroalkyl)ethylthio]propionate, and is available from E. I. du Pont de Nemours and Company, Wilmington Del.

32G373D is a green pigment that contains (1,3,8,16,18,24-hexabromo-2,4,9,10,11,15,17,22,23,25-decachlorophthalocyaninato(2−)).

32G459D is a green pigment that contains copper, [tridecachloro-29H,31H-phthalocyaninato(2−)-N29,N30,N31,N32]-.

15599-52 is a yellow pigment that contains nickel, [[5,5'-(azo-κN1)bis[2,4,6(1H,3H,5H)-pyrimidinetrionato-κO4]](2−)]-, compound with 1,3,5-triazine-2,4,6-triamine.

32R519D is Red 32R519D pigment dispersion, 40% in water (Penn Color, Doylestown, Pa.).

32Y145D is Red 32Y145D pigment dispersion, 40% in water (Penn Color, Doylestown, Pa.).

32S412D is Blue 32S412D pigment dispersion, 40% in water (Penn Color, Doylestown, Pa.).

32S349D is Blue 32S349D pigment dispersion, 40% in water (Penn Color, Doylestown, Pa.).

Surfynol DF110D (Air Products and Chemicals, Allentown, Pa.) is a nonionic, nonsilicone, acetylenic-based, defoamer (2,5,8,14-tetramethyl-6-dodecyne-5,8-diol, CAS [68227-33-8]), at 32% active solids in dipropylene glycol.

A Tencor P-15 Stylus profilometer (KLA-Tencor, San Jose, Calif.) was used to measure the height (in microns) of transferred material and determine surface roughness values that are reported as Wa (roughness quotient) in nm.

Example 1

Preparation of Formulations

De-ionized water and Carboset® GA 2300 solution (density=1.066 g/L) were added to a vial, followed by addition of pigments. The pigments were chosen as per the color required. The mixture was shaken for 5 min. SDA 4927 IR dye was then added, followed by the addition of the fluorosurfactant (0.180 g), and Surfynol® DF 110D (0.030 g). The mixture was then shaken for 2 to 12 h.

The amount of water, pigments, Carboset® GA 2300 solution, and polyhydroxy compound used in each formulation are given in Tables 2 to 4. Samples A-G, B-R and C-B are the comparative samples for the green, red and blue colors respectively.

TABLE 2

Composition of Pigmented Formulations for green color.

| Sample | Water | Polycarboxylic acid (Carboset ® GA 2300) | Pigment 1 32G373D | Pigment 2 32G459D | Pigment 3 15599-52 | Polyol DPP-130 | Dye SDA 4927 | Ionic liquid | % wt of ionic liquid |
|---|---|---|---|---|---|---|---|---|---|
| 1-G | 4.091 g | 5.906 g | 1.037 g | 0.581 g | 1.735 g | None | 0.015 g | 0.060 g | 2 |
| 2-G | 4.242 g | 5.695 g | 1.037 g | 0.581 g | 1.735 g | None | 0.015 g | 0.120 g | 4 |
| 3-G | 4.317 g | 5.59 g | 1.037 g | 0.581 g | 1.735 g | None | 0.015 g | 0.150 g | 5 |
| 4-G | 4.693 g | 5.064 g | 1.037 g | 0.581 g | 1.735 g | None | 0.015 g | 0.300 g | 10 |
| 5-G | 5.069 g | 5.906 g | 1.037 g | 0.581 g | 1.735 g | None | 0.015 g | 0.450 g | 15 |
| 6-G | 4.712 g | 5.039 g | 1.037 g | 0.581 g | 1.735 g | 0.247 g | 0.015 g | 0.060 g | 2 |
| 7-G | 4.865 g | 5.823 g | 1.037 g | 0.581 g | 1.735 g | 0.247 g | 0.015 g | 0.120 g | 4 |
| 8-G | 5.249 g | 4.286 g | 1.037 g | 0.581 g | 1.735 g | 0.222 g | 0.015 g | 0.300 g | 10 |
| A-G | 5.169 g | 5.169 g | 1.037 g | 0.581 g | 1.735 g | 0.240 g | 0.015 g | None | 0 |

(Where G stands for Green color)

TABLE 3

Composition of Pigmented Formulations for red color

| Sample | Water | Polycarboxylic acid (Carboset ® GA 2300) | Pigment 1 32R519D | Pigment 2 32Y145D | Polyol DPP-130 | Dye SDA 4927 | Ionic liquid | % wt of ionic liquid |
|---|---|---|---|---|---|---|---|---|
| 9-R | 4.248 g | 6.304 g | 3.908 g | 0.349 g | None | 0.041 g | 0.060 g | 2 |
| 10-R | 4.474 g | 5.988 g | 3.908 g | 0.349 g | None | 0.041 g | 0.150 g | 5 |
| 11-R | 4.850 g | 5.462 g | 3.908 g | 0.349 g | None | 0.041 g | 0.300 g | 10 |
| 12-R | 5.227 g | 4.936 g | 3.908 g | 0.349 g | None | 0.041 g | 0.450 g | 15 |
| 13-R | 5.488 g | 4.507 g | 3.908 g | 0.349 g | 0.246 g | 0.041 g | 0.300 g | 10 |
| B-R | 5.027 g | 5.216 g | 3.908 g | 0.349 g | 0.315 g | 0.041 g | None | 0 |

(Where R stands for Red color)

TABLE 4

Composition of Pigmented Formulations for blue color

| Sample | Water | Polycarboxylic acid (Carboset ® GA 2300) | Pigment 1 32S412D | Pigment 2 32S349D | Polyol DPP-130 | Dye SDA 4927 | Ionic liquid | % wt of ionic liquid |
|---|---|---|---|---|---|---|---|---|
| 14-B | 5.923 g | 5.534 g | 1.579 g | 1.424 g | None | 0.31 g | 0.060 g | 2 |
| 15-B | 6.120 g | 5.259 g | 1.579 g | 1.424 g | None | 0.31 g | 0.150 g | 5 |
| 16-B | 6.448 g | 4.801 g | 1.579 g | 1.424 g | None | 0.31 g | 0.300 g | 10 |
| 17-B | 6.774 g | 4.334 g | 1.579 g | 1.424 g | None | 0.31 g | 0.450 g | 15 |
| 18-B | 5.924 g | 5.534 g | 1.579 g | 1.424 g | 0.237 g | 0.31 g | 0.060 g | 2 |
| 19-B | 6.448 g | 4.901 g | 1.579 g | 1.424 g | 0.207 g | 0.31 g | 0.300 g | 10 |
| C-B | 6.098 g | 5.416 g | 1.579 g | 1.424 g | 0.315 g | 0.31 g | None | 0 |

(Where B stands for Blue color)

Example 2

General Procedure for Making Donor Elements and Imaging

After a pigmented formulation mixture of Example 1 had been shaken for several hours, the pigmented formulation (10 ml) was filtered through a 1 μm syringe filter onto a Mylar® sheet in front of a draw-down bar. The draw-down bar was used to deposit the formulation uniformly across the Mylar® sheet. The coated Mylar® sheet was heated in a drying oven for 5 min to form a thermal transfer layer on the Mylar® sheet. Imaging was carried out by contacting the thermal transfer layer with a receiver (a glass sheet), and directing laser radiation through the transparent donor support (the Mylar® sheet) and onto the thermal transfer layer. The portion of the thermal transfer layer that had been exposed to the laser radiation was transferred to the glass and remained on the glass when the Mylar® sheet and the receiver were separated.

Example 3

General Procedure for Testing Surface Features

The process described in Example 2 was carried out three times—once for each of the three colors—to construct a panel of three-color pixels. Each pixel contained a red, a blue, and a green color filter, and each color filter was separated from other color filters by a rubber black matrix (RBM). The glass and transferred layers were then annealed at 230° C. for 1 h in air.

In determining the color filter height reduction, one color filter of each set of three was derived from a formulation that contained a polyhydroxy compound and the other two color filters contained no polyhydroxy compound. After annealing, the panel was analyzed using a KLA-Tencor Profilometer to determine to determine the surface smoothness, pixel heights, and lip heights of each color filter as recorded in Table 5.

Example 4

General Procedure for Block Testing

The film obtained from Example 2 was cut in a square-shaped piece (3.5"×3.5"). The piece was placed on clean glass with the film side up and was kept in an environmental chamber (humidity: 60% and temperature: 35° C.) for 15 min. A square foam piece was placed on top of the film and a second glass square piece placed on top of the foam. A weight (1.2 kg, a solid steel cylinder about 1.5-2.0 inches in diameter and 5-6 inches long) was placed on the second glass piece and the entire assembly was left in the chamber for another 15 min. The assembly was removed from the chamber and the weight, the second glass film and the foam were taken off. The film was peeled off and the amount of the donor that transferred to the glass was estimated. Table 5 shows the ratings obtained for different samples.

In one embodiment, the average surface roughness of a green color filter was 3.82 nm when 10% by weight of an ionic liquid (1-butyl-3-methylimidazolium tetrafluoroborate) was used in the aqueous formulation. In contrast, when no ionic liquid was added, the average surface roughness was 8.8 nm.

In another embodiment the average lip height of green color filter was 0.486 micron on addition of 5% by weight of 1,2,3-trimethylimidazolium methylsulfate to the aqueous formulation. Where no ionic liquid was added, the average lip height was 0.658 micron.

In yet another embodiment the pixel height of a green color filter was 0.093 micron when the corresponding aqueous formulation contained 15% by weight of 1-butyl-3-methylpyridinium bis(trifluoromethyl sulfonyl)imide. When no ionic liquid was added to the aqueous formulation, the pixel height of a green pixel was 0.988 micron.

TABLE 5

Surface features and percentage transfer rating

| Ionic liquid | Sample | Average Surface Roughness (Wa) (in nm) | Average lip-height (in microns) | Pixel height (in microns) | % transfer (rating) |
|---|---|---|---|---|---|
| None | A-G | 8.8 | 0.656 | 0.988 | No transfer |
| (Comparative | B-R | 13.23 | 0.750 | 1.051 | No transfer |
| Examples) | C-B | 7.31 | 0.421 | 0.907 | No transfer |
| 1,2,3- | 1-G | 10.78 | 0.639 | 0.537 | n.d. |
| Trimethylimidazolium | 3-G | 9.06 | 0.486 | 0.721 | n.d. |
| methyl sulfate | 4-G | 7.04 | 0.741 | 0.537 | n.d. |
| 1,2,4- | 1-G | 7.66 | 0.596 | 0.561 | n.d. |
| Trimethylpyrazolium | 3-G | 8.38 | 0.607 | 0.579 | n.d. |
| methyl sulfate | 9-R | 5.92 | 0.896 | 1.077 | n.d. |
| | 10-R | 8.83 | 0.695 | 1.044 | n.d. |
| | 11-R | 3.14 | 0.371 | 1.17 | n.d. |
| | 12-R | 7.41 | 0.572 | 1.02 | n.d. |
| | 14-B | 7.86 | 0.359 | 0.797 | n.d. |
| | 15-B | 10.37 | 0.456 | 0.712 | n.d. |
| | 18-B | n.d. | n.d. | n.d. | 1 |
| 1-Butyl-3- | 1-G | 8.08 | 0.649 | 0.469 | n.d. |
| methylimidazolium | 3-G | 6.74 | 0.540 | 0.479 | n.d. |
| dibutyl phosphate | 7-G | 9.3 | 0.521 | 0.478 | n.d. |
| | 9-R | 4.02 | 1.02 | 1.08 | n.d. |
| | 10-R | 4.86 | 0.995 | 0.981 | n.d. |
| | 11-R | 5.56 | 0.668 | 0.801 | n.d. |
| | 12-R | 6.89 | 0.736 | 0.820 | n.d. |
| | 13-R | 6.96 | 0.714 | 0.998 | n.d. |
| | 14-B | 8.2 | 0.33 | 0.795 | 0 |
| | 15-B | 9.44 | 0.429 | 0.576 | 0 |
| | 16-B | 9.87 | 0.528 | 0.500 | 1 |
| | 17-B | 8.93 | 0.614 | 0.380 | n.d. |
| | 18-B | 6.57 | 0.398 | 0.878 | n.d. |
| 1-Butyl-3- | 1-G | 8.28 | 0.64 | 0.42 | n.d. |
| methylimidazolium | 1-G | 8.28 | 0.664 | 0.536 | n.d. |
| tetrafluoroborate | 3-G | n.d. | 0.623 | 0.482 | n.d. |
| | 4-G | 3.82 | 0.758 | 0.48 | n.d. |
| | 4-G | 3.82 | 0.745 | 0.496 | n.d. |
| 1-Butyl-3-methyl | 1-G | n.d. | n.d. | 0.607 | n.d. |
| imidazolium | 3-G | n.d. | n.d. | 0.664 | n.d. |
| hexafluoro | | | | | |
| phosphate | | | | | |
| 1-Butyl-3- | 1-G | n.d. | 0.578 | 0.455 | n.d. |
| methylimidazolium | 3-G | n.d. | 0.682 | 0.322 | n.d. |
| thiocyanate | | | | | |
| 1-Butyl-3- | 2-G | n.d. | n.d. | 0.295 | n.d. |
| methylpyridinium | 4-G | n.d. | n.d. | 0.355 | n.d. |
| bis(trifluormethylsulfonyl) | 5-G | n.d. | n.d. | 0.093 | n.d. |
| imide | | | | | |
| 1-Ethyl-3- | 1-G | 6.04 | 0.659 | 0.526 | n.d. |
| methylimidazolium | 3-G | 6.42 | 0.648 | 0.431 | n.d. |
| dibutyl phosphate | 9-R | 5.58 | 0.724 | 1.135 | n.d. |
| | 10-R | 6.51 | 0.58 | 0.805 | n.d. |
| | 11-R | 5.67 | 0.519 | 0.760 | n.d. |
| | 14-B | 9.85 | 0.303 | 0.948 | 0 |
| | 15-B | 11.59 | 0.359 | 0.74 | n.d. |
| | 16-B | 11.62 | 0.583 | 0.453 | 1 |
| | 17-B | 12.12 | 0.673 | 0.307 | 6 |
| | 18-B | 8.09 | 0.38 | 0.836 | 3 |
| Methyltrioctyl | 2-G | 7.64 | 0.628 | 0.378 | n.d. |
| ammonium | | | | | |
| thiosalicylate | | | | | |
| Tributylmethyl | 1-G | 9.3 | 0.572 | 0.7 | n.d. |
| phosphonium | 3-G | 5.16 | 0.571 | 0.549 | n.d. |
| dibutyl phosphate | 4-G | 9.96 | 0.679 | 0.426 | n.d. |
| | 9-R | 5.7 | 0.461 | 1.15 | n.d. |
| | 10-R | 4.99 | 0.484 | 1.06 | n.d. |
| | 11-R | 10.18 | 0.337 | 0.903 | n.d. |
| | 14-B | 9.8 | 0.56 | 0.38 | n.d. |
| | 15-B | 10.32 | 0.609 | 0.264 | n.d. |
| | 16-B | 7.19 | 0.25 | −0.047 | n.d. |
| | 17-B | 10.9 | 0.319 | −0.121 | n.d. |
| | 18-B | 7.29 | 0.587 | 0.364 | n.d. |

TABLE 5-continued

| Surface features and percentage transfer rating | | | | | |
|---|---|---|---|---|---|
| Ionic liquid | Sample | Average Surface Roughness (Wa) (in nm) | Average lip-height (in microns) | Pixel height (in microns) | % transfer (rating) |
| Tris(2-hydroxyethyl) methyl ammonium methylsulfate | 1-G | n.d. | 0.540 | 0.797 | n.d. |
| | 3-G | n.d. | 0.541 | 0.840 | n.d. |
| | 4-G | n.d. | 0.685 | 0.788 | n.d. |
| | 5-G | n.d. | 0.775 | 0.496 | n.d. |
| | 7-G | n.d. | 0.551 | 0.623 | n.d. |
| | 9-R | 3.92 | 0.648 | n.d. | n.d. |
| | 10-R | 3.88 | 0.629 | n.d. | n.d. |
| | 11-R | 2.8 | 0.737 | n.d. | n.d. |
| | 12-R | 3.73 | 0.563 | n.d. | n.d. |
| | 14-B | 10.44 | 0.392 | 0.836 | n.d. |
| | 15-B | 8.84 | 0.383 | 0.819 | n.d. |
| | 16-B | 8.40 | 0.326 | 1.06 | n.d. |
| | 17-B | 7.22 | 0.31 | 0.954 | n.d. |
| | 18-B | 9.79 | 0.434 | 0.860 | n.d. |

n.d.: not determined

What is claimed is:

1. A thermal transfer donor element comprising:

(a) a support;

(b) a thermal transfer layer disposed upon the support, wherein the thermal transfer layer is derived from a composition comprising a polycarboxylic acid and an ionic liquid, wherein the polycarboxylic acid is a copolymer comprising repeat units derived from styrene and a carboxylic comonomer selected from the group consisting of acrylic acids, methacrylic acids, and combinations thereof; and (c) an infrared-absorbing compound.

2. The donor element of claim 1, wherein the copolymer has a molecular weight of 2,000 to 50,000 g/mole.

3. The donor element of claim 1, wherein the composition further comprises a polyhydroxy compound.

4. The donor element of claim 1, wherein the ionic liquid comprises:

(a) a cationic part selected from the group consisting of ammonium, choline, imidazolium, phosphonium, pyrazolium, pyridinium, pyrrolidinium, and sulfonium ions; and (b) an anionic part selected from the group consisting of carbonate, acetate, benzoate, phosphates, sulfonates, fluoride, chloride, bromide, iodide, hydroxide, nitrite, bis(trifluoromethyl)sulfonimidate, nonafluorobutanesulfonate, thiophenolate, succinimide, tribromide, triiodide, trifluoroacetate, salicylate, hexafluorophosphate, tetrafluoroborate, dibutylphosphate, dicyanamide, hexafluoroantimonate, methanesulfonate, methyl sulfonate, methyl sulfate, nitrate, tetrachloroaluminate, tosylate, thiocyanate, dimethylphosphate, tris(trifluoromethylsulfonyl)methanide, ethyl sulfate, methyl carbonate, diethyl phosphate, lactate, and decanoate ions, and combinations thereof.

5. The donor element of claim 1, wherein the thermal transfer layer further comprises a colorant selected from the group consisting of organic pigments, inorganic pigments, dyes, and combinations thereof.

6. The donor element of claim 1, wherein the thermal transfer layer further comprises a surfactant and a defoaming agent.

7. The donor element of claim 1, further comprising a heating layer disposed between the support and the thermal transfer layer.

8. The donor element of claim 1, wherein the infrared absorbing compound is present in the thermal transfer layer or is present in a heating layer disposed between the support and the thermal transfer layer.

9. The donor element of claim 1, wherein the support is selected from the group consisting of polyester films, polyolefin films, polyamide films, paper, sheets of glass, and fluoro-olefin films.

10. An imageable assemblage comprising:

(a) a donor element comprising a transparent donor support and a thermal transfer layer disposed on the support, wherein the thermal transfer layer is derived by heating to 40° C. to 60° C. a composition comprising a polycarboxylic acid and an ionic liquid, wherein the polycarboxylic acid is a copolymer comprising repeat units derived from styrene and a carboxylic comonomer selected from the group consisting of acrylic acids, methacrylic acids, and combinations thereof; and (b) a receiver in contact with the thermal transfer layer of the donor element.

11. The imageable assemblage of claim 10, wherein the donor element further comprises a heating layer disposed between the donor support and the thermal transfer heating layer.

* * * * *